United States Patent [19]

Yamauchi et al.

[11] Patent Number: 4,821,531

[45] Date of Patent: Apr. 18, 1989

[54] REFRIGERANT EVAPORATOR

[75] Inventors: Yoshiyuki Yamauchi, Chita; Toshio Ohhara, Kariya; Shinji Ogawa, Aichi; Isao Kuroyanagi; Haruhiko Otsuka, both of Anjo; Toshio Takahashi, Oobu; Osamu Kasebe, Okazaki, all of Japan

[73] Assignee: Nippondenso Co., Ltd., Kariya, Japan

[21] Appl. No.: 130,542

[22] Filed: Dec. 9, 1987

[30] Foreign Application Priority Data

Dec. 11, 1986 [JP] Japan ..... 61-295398
Oct. 9, 1987 [JP] Japan ..... 62-255250

[51] Int. Cl.[4] ..... F25B 39/02
[52] U.S. Cl. ..... 62/515; 165/166
[58] Field of Search ..... 62/515; 165/166

[56] References Cited

U.S. PATENT DOCUMENTS

| | | | |
|---|---|---|---|
| 3,030,782 | 4/1982 | Karmazin | 62/515 |
| 4,470,455 | 9/1984 | Sacca | 165/166 |
| 4,487,038 | 12/1984 | Iijima | 62/515 |
| 4,502,297 | 3/1985 | Winterer | 62/515 |
| 4,586,566 | 5/1986 | Kern et al. | 62/515 |
| 4,696,342 | 9/1987 | Yamauchi et al. | 165/166 |

FOREIGN PATENT DOCUMENTS 53-32378 8/1978 Japan .
53-32377 8/1978 Japan .

*Primary Examiner*—Ronald C. Capossela
*Attorney, Agent, or Firm*—Cushman, Darby & Cushman

[57] ABSTRACT

A structural arrangement for an evaporator producing a uniform temperature gradient across its width. The structure is arranged so as to even out the flow of refrigerant within the evaporator. A first tank portion has a inlet and a second tank portion has a outlet. One end of each of plural tubes are connected thereto. A plurality of tubes allow refrigerant to flow from the first tank portion to the second. The tubes are arranged so as to provide equal flow distances for refrigerant across the evaporator, taking into account the directions of flow in the first and second tank portions. In a second embodiment, the inlet port and the outlet port are disposed at the first tank portion and the second tank portion respectively in such a manner that directions of the refrigerant flow within the first tank portion and the second tank portion are opposite to each other. In a third embodiment, one end of a first tube of the plurality is connected to the first tank portion closer to one end of the first tank portion, than where one end of a second tube is connected to the second tank portion closer to the other end of the second tank portion than the other end of the second tube. The inlet port is disposed close to one end of the first tank portion and the outlet port is disposed close to one end of the second tank portion.

20 Claims, 14 Drawing Sheets

FIG. 27
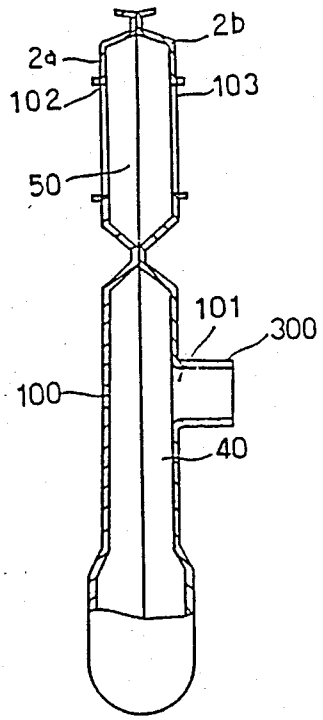
FIG. 26
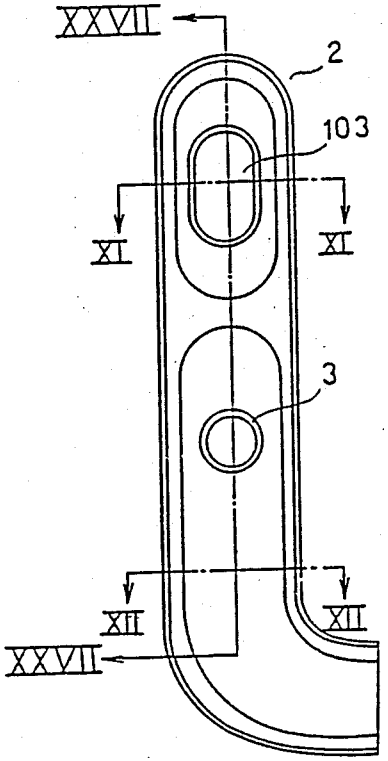
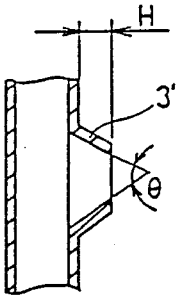
FIG. 28
FIG. 25
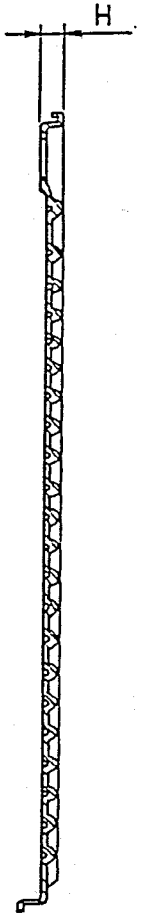
FIG. 24
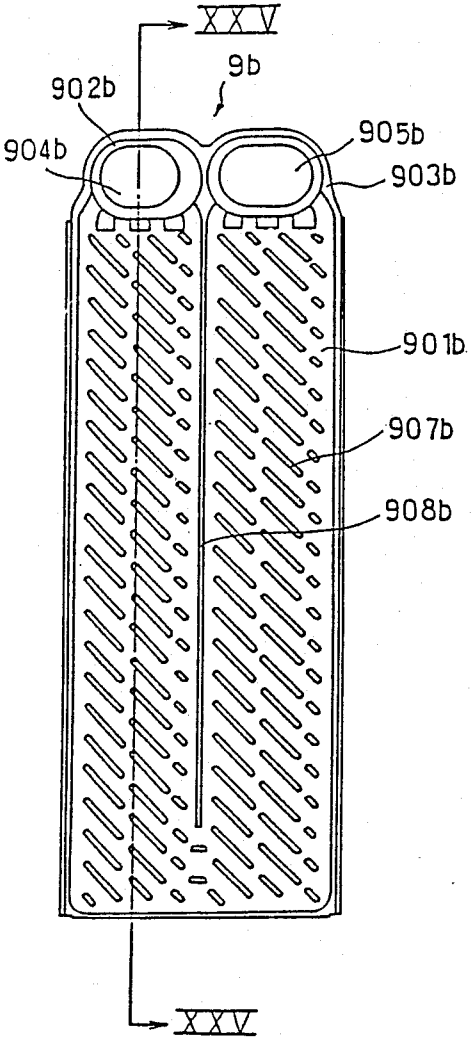

FIG. 33
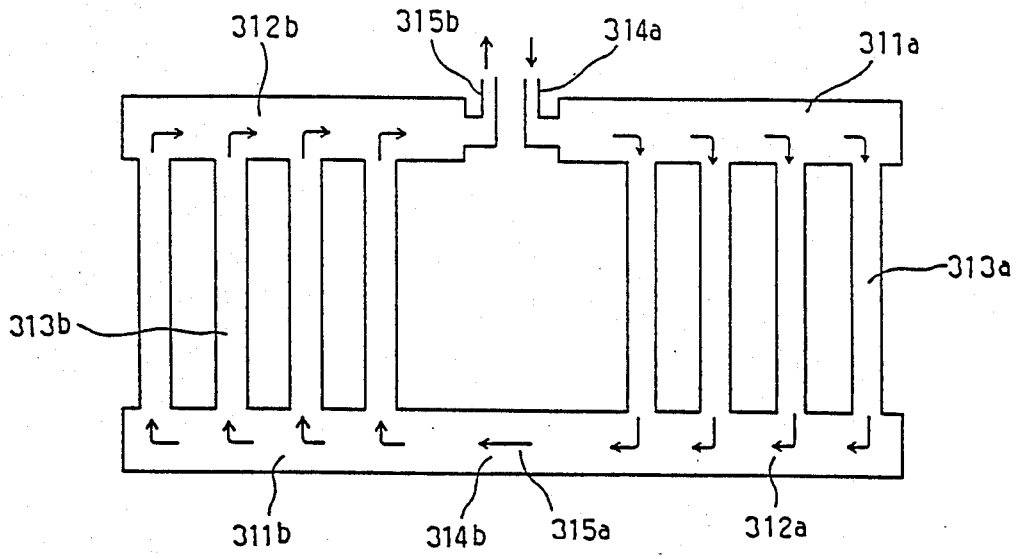
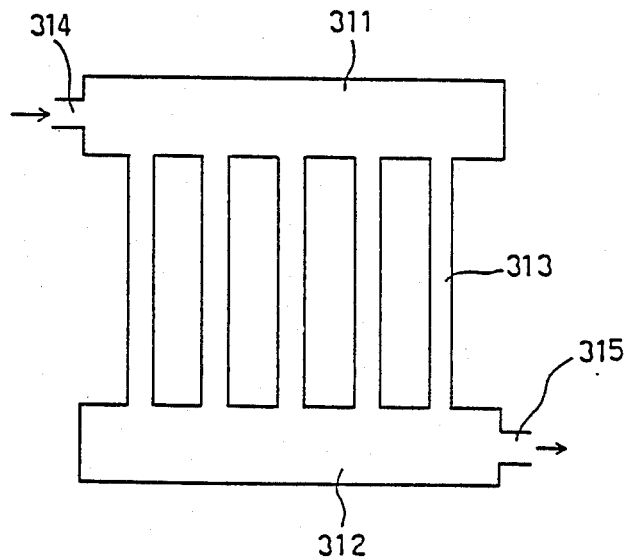
FIG. 34
(PRIOR ART)
FIG. 35
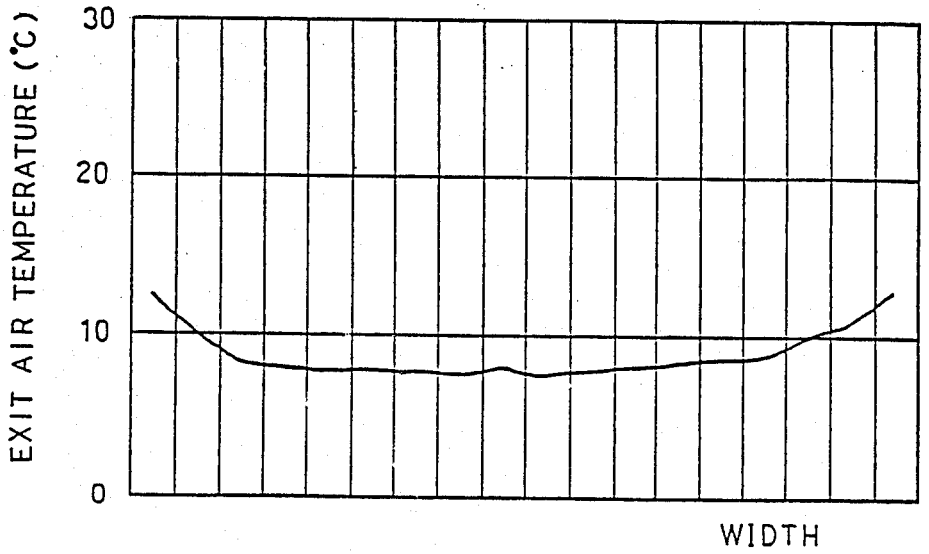

REFRIGERANT EVAPORATOR

BACKGROUND OF THE INVENTION

1. Field of the Invention

The present invention relates to heat exchangers that may be used as evaporators in a refrigeration/air conditioning system. It is particularly well suited for use in an automotive vehicle air conditioning system.

2. Description of the Prior Art

Japanese examined utility model (Koukoku) No. 53-32378 discloses a heat exchanger used as an evaporator of the type shown in FIG. 19. It has a plurality of tube-units 510 each formed by a pair of plates 511 and 512 joined to each other. Each tube-unit 510 has a U-shaped tube portion 516 and a first tank portion 515 and a second tank portion 518 disposed at opposite ends of the tube portion. Tube-units 510 are connected to each other with corrugated fins 517 disposed between them. An inlet pipe 501 is joined to the first tank portion 515 disposed at one end of the U-shaped tube for introducing refrigerant therethrough. An outlet pipe 502 is joined to the second tank portion 518 disposed at the other end of the U-shaped tube 516 for allowing refrigerant to flow out from the second tank portion.

FIG. 20 graphically illustrates the relationship between a flow pattern of refrigerant in various evaporator configurations and a temperature gradient (as a function of position along the heat exchanger) of air passed through the heat exchanger when it is used as an evaporator of refrigerant. The refrigerant flow pattern for various structural arrangements of heat exchangers is shown schematically in the upper portions of FIG. 20 and the air temperature just downstream of the heat exchanger is indicated at a lower portion of FIG. 20.

In the evaporator indicated in the "A" portion of FIG. 20, refrigerant introduced into the first tank portion 515 through the inlet pipe 501 flows to the second tank portion 518 through the U-shaped tube portions 516. The temperature of the air gradually decreases from the position close to the inlet pipe to the position close to the outlet pipe.

The evaporator which is indicated in the "B" portion of FIG. 20 has a separate plate 520 in the first tank portion 515. The refrigerant flow into the front portion 515*a* of the first tank portion 515 through the inlet pipe 501 is interrupted so that the refrigerant flows into the second tank portion 518 through the U-shaped tube 516 which opens to the front portion 515*a* of the first tank portion 515. The refrigerant introduced into the second tank portion 518 then flows toward the rear portion 515*b* of the first tank portion 515 through the U-shaped tube 516 which opens to the rear portion. Refrigerant which has flowed into the first tank portion 515 flows out through the outlet pipe 502. The temperature of air gradually decreases from the position close to the inlet pipe 501 to the position close to the separate plate 520. The temperature of air is high at a portion of the evaporator that corresponds to a flow of refrigerant downstream of the separate plate 520 and gradually decreases from the position close to the inlet pipe 501 to the position close to the separate plate 520. The temperature of air is high at the downstream of the separate plate 520 and gradually decreases from the position close to the separate plate 520 to the position close to the outlet pipe 502.

In the evaporator indicated in the "C" portion of FIG. 20, a separate plate 520*a* is disposed in the first tank portion 515 in order to divide the first tank portion 515 into a front portion 515*a* and a rear portion 515*b* and a separate plate 520*b* is disposed in the second tank portion 518 in order to divide the second tank portion 518 into a front portion 518*a* and a rear portion 518*b*. The refrigerant flowed into the tank portion 515 through the inlet pipe 501 is interrupted by the separate plate 520*a*, so that the refrigerant flows into the front portion 518*a* of the second tank portion 518 through the U-shaped tube 516. After that the refrigerant flows into the rear portion 515*b* of the first tank portion 515 through the U-shaped tube 516 which connects the front portion 518*a* of the second tank portion 518 and the rear portion 515*b* to the first tank portion 515. The refrigerant flows from the rear portion 515*b* of the first tank portion 515 to the rear portion 518*b* of the second tank portion 518 through the U-shaped tube 516 which connects the rear portion 515*b* of the first tank portion 515 and the rear portion 518*b* of the second tank portion 518. The temperature of air becomes low at the upstream of the separate plate 520*a* or the separate plate 520*b* and becomes high downstream of them.

FIG. 21 is a schematic diagram of the flow pattern of the refrigerant in a conventional evaporator. Refrigerant flows into the tank portion 515 through the inlet pipe 501 in a gas-liquid phase. Mist of the liquid refrigerant is mixed with gas refrigerant. The quantity and velocity of refrigerant flowing in the tank portion and the tube portion increases, especially when the heat exchanging capacity required for the evaporator becomes high. The force of inertia of the liquid refrigerant in tank portion 518 flowing toward the wall shown in the right side of FIG. 21 increases with high velocity flow of refrigerant. The quantity of liquid refrigerant around the inlet port is, therefore, much smaller than that of the liquid refrigerant in front of the wall, namely downstream. A large amount of the liquid refrigerant mixed in the gas refrigerant as a mist flows toward the wall 521 in the tank portion 518 by the force of inertia.

The liquid refrigerant mainly flows into the U-shaped tube portion opening ahead of an end wall of the tank portion and the gas refrigerant mainly flows into the U-shaped tube portion opening around the inlet pipe. Therefore there is an imbalance of distribution of refrigerant flowing into the tube portion. Such imbalance causes the temperature gradient of air output across the width of the evaporator to be uneven.

FIG. 34 is a schematic view of a conventional evaporator. A first tank portion 311 has an inlet port 314 at the left side thereof. One end of each a plurality of tubes 313 is connected to the first tank portion 311 and the other end of each of tubes 313 is connected to a second tank portion 312. The second tank portion 312 has an outlet port 315 at the right side thereof from which refrigerant flows.

SUMMARY OF THE INVENTION

FIG. 31 is a schematic view of the present invention. In large part, the reason that known evaporator arrangements have non-uniform temperature gradients along their widths is that their structures promote an uneven flow of refrigerant through the evaporator. A portion of the evaporator receiving little flow of refrigerant will not have the cooling capacity that a portion of the evaporator having a high flow rate will have. The central concept of the invention is to provide a plurality of substantially equal flow paths for refrigerant along the entire width of the evaporator. A first tank portion 311 has an inlet port 314 for introducing the refrigerant thereinto and each one end of a plurality of tubes 313 are connected thereto. The other ends of tubes 313 are connected to a second tank portion 312, and the refrigerant introduced into the first tank portion 311 flows into the second tank portion 312 through each of tubes 313. The second tank portion 312 has a outlet port 315 for deriving the refrigerant therefrom.

In a first embodiment of the invention, the structure of the evaporator is designed so that the length of the refrigerant flow for each point along the width of the evaporator is substantially the same. A plurality of tubes 313 connect a first tank portion 311 with a second tank portion 312. The first tank portion has an inlet port 314 and the second tank portion has an outlet port 315. The tubes and inlet and outlet ports are arranged so as to even the flow of refrigerant along the evaporator. More specifically, the length of the refrigerant flow passage via one of a pair of tubes 313 one end of which is connected at a position closer to the inlet port 314 along with the direction of the refrigerant flow within the first tank portion 311 than a position at which one end of another one of the pair of the tubes 313 is connected is longer than the length of the refrigerant flow passage via another pair of tubes 313.

In a second embodiment of the invention, the inlet port 314 and the outlet port 315 are disposed at the first tank portion 311 and the second tank portion 312 respectively in such a manner that directions of the refrigerant flow within the first tank portion 311 and the second tank portion 312 are opposite to each other.

In a third embodiment of the invention, one end of a first tube 313*a* among the plurality of tubes 313 is connected to the first tank portion 311 closer to one end of the first tank portion 311 than a portion at which one end of a second tube 313*b* among the plurality of tubes 313 is connected. The other end of the first tube 313*a* is connected to the second tank portion 313 closer to the other end of the second tank portion 313 than the other end of the second tube 313*b*. The inlet port 314 is disposed at a position close to one end of the first tank portion 311 and the outlet port 315 is disposed at the position close to one end of the second tank portion 312.

BRIEF DESCRIPTION OF THE DRAWINGS

FIG. 24 is a front view of a main plate.

FIG. 25 is a sectional view taken along line XXV in FIG. 24.

FIG. 26 is a front view of a inlet piping unit.

FIG. 27 is a sectional view taken along XXVII—XXVII in FIG. 26.

FIG. 28 is a sectional view of a nozzle.

FIG. 33 is a schematic diagram of various embodiments of the invention.

FIG. 34 is a schematic diagram of a conventional evaporator.

DETAILED DESCRIPTION OF THE PREFERRED EMBODIMENTS

Figure 1:
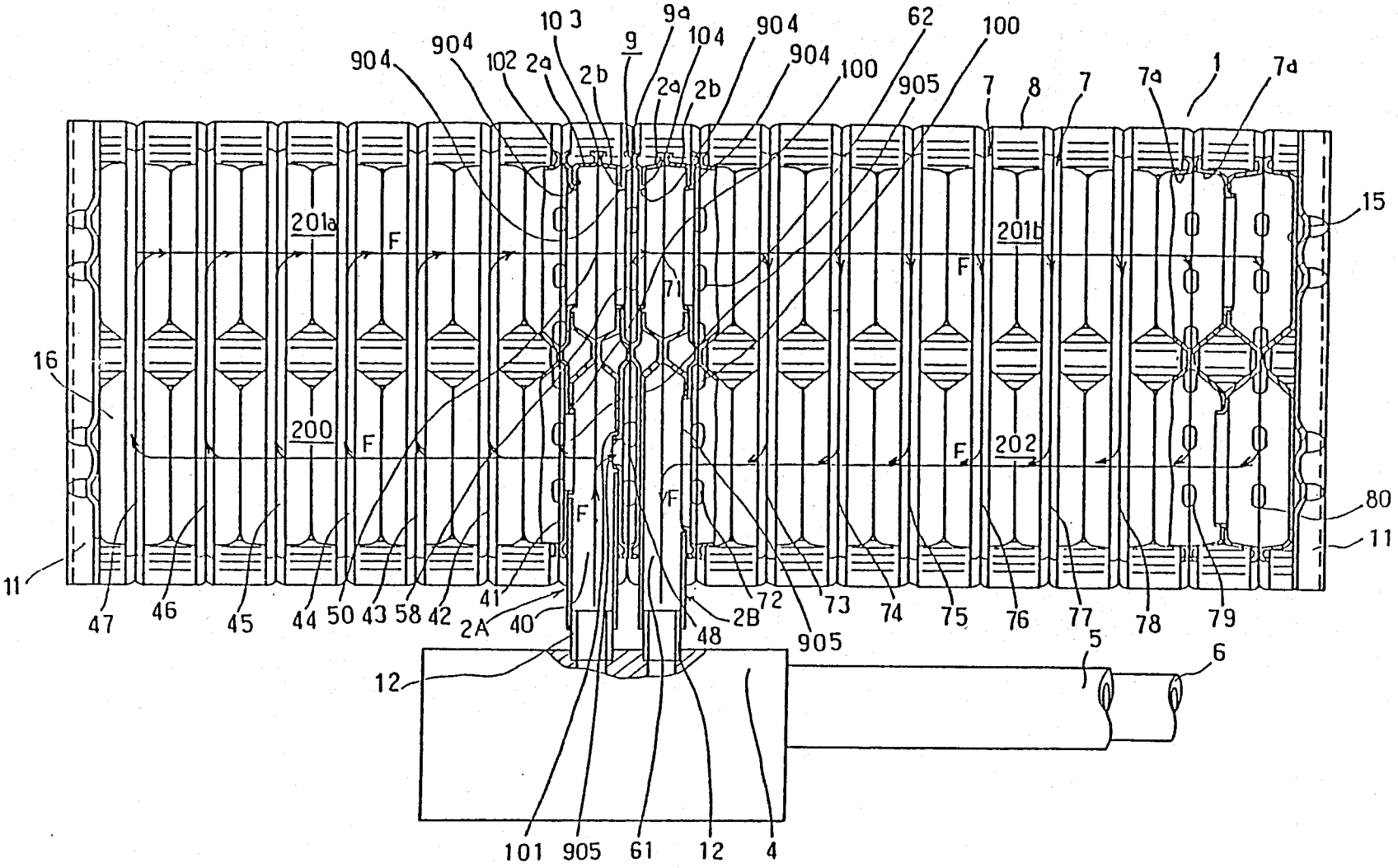
FIG. 1 is a top view of an evaporator representative of a first embodiment of the present invention.
Figure 2:
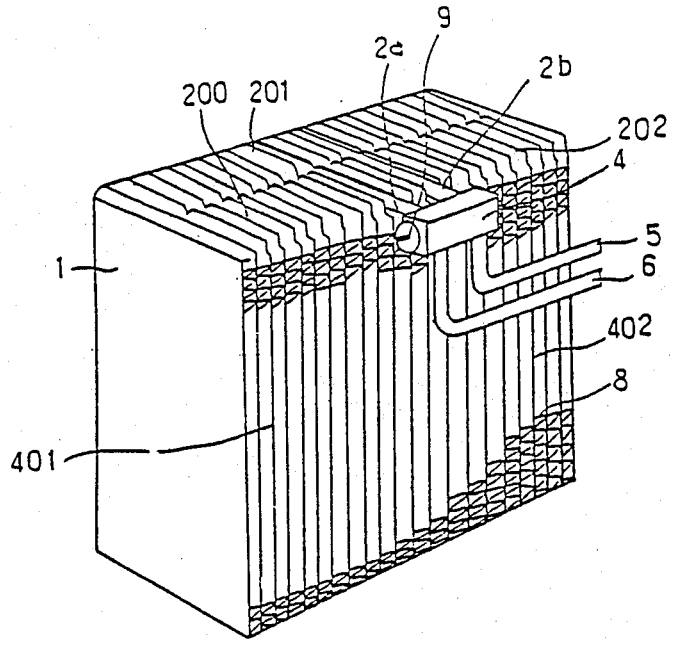
FIG. 2 is a perspective view of the first embodiment of the invention.

The present invention will now be described with reference to an embodiment wherein the refrigerant evaporator is usable in an automotive air conditioner. FIG. 2 is a perspective view of the refrigerant evaporator, and FIG. 1 is a top view of the evaporator shown in FIG. 2 wherein a central portion and right-hand side portion are illustrated in cross section. This evaporator 1 is formed by laminating a plurality of tube units 7 in the same direction. A tube unit 7 is formed by joining a pair of plates shown in FIGS. 3 through 5 together in confronting relation.

Figure 3:
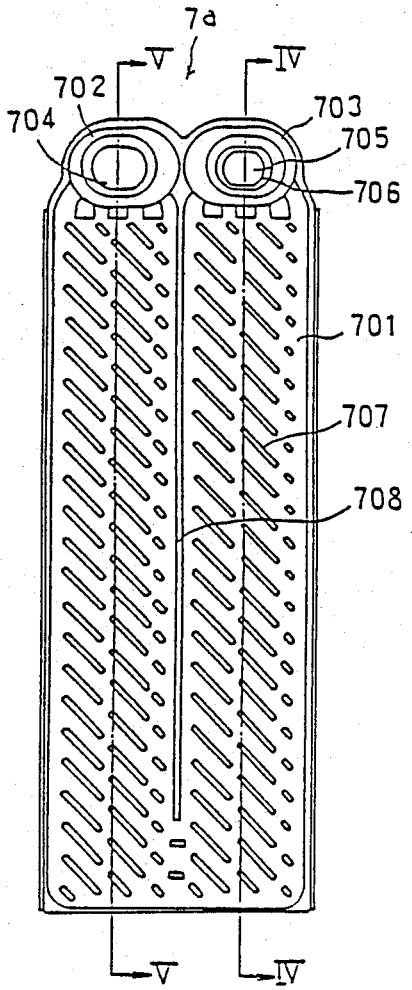
FIG. 3 is a front view of a main plate.
Figure 4:
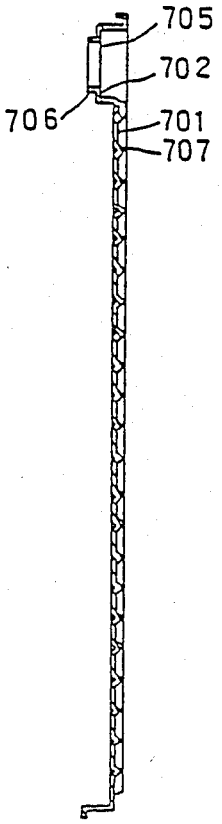
FIG. 4 is a sectional view taken along line IV—IV in FIG. 3.
Figure 5:
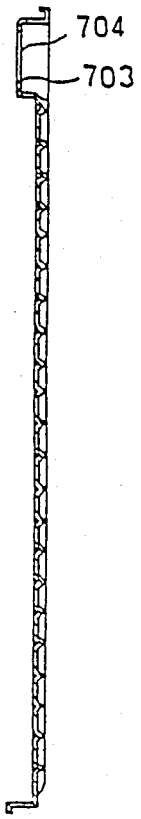
FIG. 5 is a sectional view taken along line V—V in FIG. 3.

FIG. 3 is a plan view of one main plate 7*a* to form the tube unit 7. FIG. 4 is a sectional view taken along line IV—IV in FIG. 3, and FIG. 5 is a sectional view taken along the line V—V in FIG. 3. Main plate 7*a* is made of an aluminum material having a thickness of about 0.5–0.6 mm with both sides clad with brazing material, which is shaped by press-working. The main plate 7*a* has at its one end a tank recess portion 702 and another tank recess portion 703 which are each press-formed into an elliptical shape.

Further, the main plate 7*a* is formed with a substantially U-shaped passage recess portion 701 connecting the tank recess portion 702 and the tank recess portion 703. In this passage recess portion 701 are formed a plurality of embossed ribs 707 by embossing-forming, and a center rib 708 is also provided by embossing-forming in the central portion of the main plate 7a to make a U shape. The bottoms of the tank recess portion 702 and the tank recess portion 703 are formed respectively with holes 704 and 705 for refrigerant to flow through. Further, around the hole 705 is formed a burring portion 706 serving as positioning means at the time of assembly of the evaporator.

By joining a pair of main plates 7a shown in FIGS. 3 through 5 together in confronting relation, there is formed the tube unit 7 having the U-shaped tube portion and the tank portions at either end thereof. By laminating a plurality of such tube units 7 in the same direction, there is formed the refrigerant evaporator 1, to which an inlet piping unit 2A and an outlet piping unit 2B are attached in a substantially central portion of the evaporator 1. The inlet piping unit 2A and the outlet piping unit 2B are substantially identical in configuration, this being illustrated in FIGS. 9 through 12.

Each of the inlet piping unit 2 and the outlet piping unit 2B is formed by a pair of piping unit forming plates 2a and 2b arranged in confronting relation. By joining two inlet piping unit forming plates 2a and 2b together in confronting relation, there is formed a first space 40 and a second space 50 in the inside. In the inlet piping unit 2A, the piping unit forming plate 2a is bored with a communicating hole 100 opposite to first space 40. Similarly, the inlet piping unit forming plate 2b is bored with a communicating hole 101 opposite to first space 40. In the above, the communicating hole 100 is made larger in the area of opening than the communicating hole 101. The inlet piping unit forming plates 2a and 2b are bored also with respective holes 102 and 103 opposite to second space 50 for passage of the refrigerant.

Similarly, the outlet piping unit 2B is formed by joining two forming plates together in confronting relation, leaving a first space 61 and a second space 71 inside. The second space 71 has on its either side communicating holes 104, and on the right-hand side in FIG. 1 of the first space 61 is formed an opening 103. This first space 61 has this opening 103 only.

Figure 6:
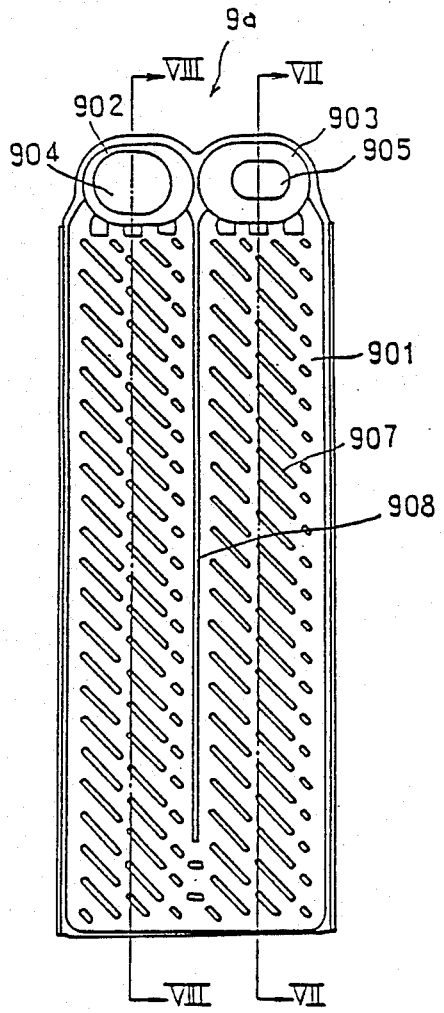
FIG. 6 is a front view of a central plate.
Figure 7:
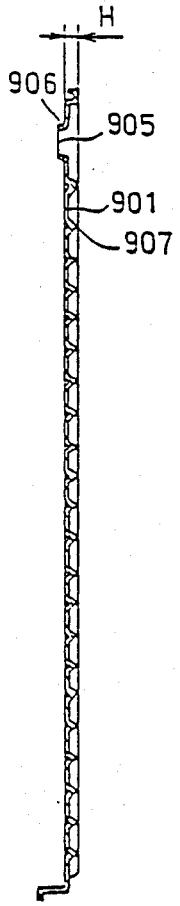
FIG. 7 is a sectional view taken along line VII—VII in FIG. 6.
Figure 8:
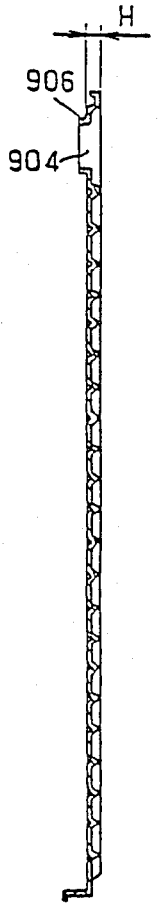
FIG. 8 is a sectional view taken along line VIII—VIII in FIG. 6.
Figure 9:
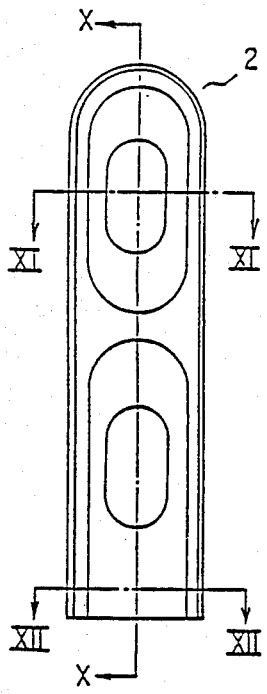
FIG. 9 is a front view of an inlet piping unit.
Figure 10:
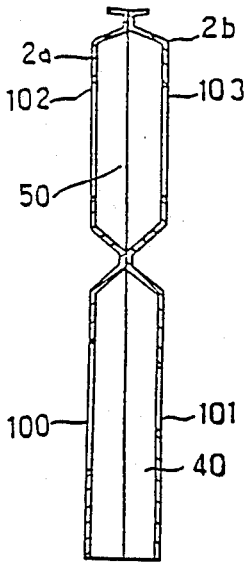
FIG. 10 is a sectional view taken along line X—X in FIG. 9.
Figure 11:
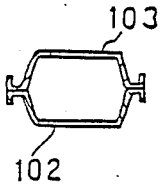
FIG. 11 is sectional view taken along line XI—XI in FIG. 9.
Figure 12:
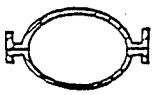
FIG. 12 is a sectional view taken along line XII—XII in FIG. 10.

A central tube unit 9 formed by central plates 9a is disposed and held at the position between the inlet piping unit 2A and the outlet piping unit 2B. This central tube unit 9 is formed by joining a pair of central plates 9a shown in FIGS. 6 through 8 together in confronting relation. The central plate 9a is substantially identical in configuration with the aforementioned tube plate 7a and has a U-shaped passage-forming recess 901 and tank-forming recess portions 902 and 903 at either end thereof. The bottoms of the tank-forming recess portions 902 and 903 are bored with respective holes 904 and 905 for passage of the refrigerant.

The difference between the central plate 9a and the tube plate 7a resides in the recession depth H of the tank recess portions 902 and 903. That is, the recession depth H of the tank recesses 902 and 903 of the central plate 9a is made smaller than the recession depth of the tube plate. A burring 906 is formed around the hole 904. In addition, a plurality of ribs 907 are formed in the passage-forming recess portion 901 by embossing, and in the central portion is formed a center rib 908 by embossing. The communicating hole 905 is made smaller in the area of opening than the communicating hole 904. By joining two such central plates 9a together in confronting relation, there is formed the central tube unit 9, this central tube unit 9 being held between the inlet piping unit 2A and the outlet piping unit 2B.

The central tube unit 9 has a first space 48 and a second space 58 therein. The first space 48 is communicated with the first space 40 of the inlet piping unit 2A through the communicating hole 904 bored in the central plate 9a. Further, the second space 58 of the central tube unit 9 is communicated via the communicating hole 904 with the second space 50 of the inlet piping unit 2A and the second space 71 of the outlet piping unit 2B.

The first space 48 of the central tube unit 9 is isolated from the first space 61 of the outlet piping unit 2B. Accordingly, the first space 40 of the inlet piping unit 2A and the first space 61 of the outlet piping unit 2B are in a non-communicating state.

The central plates 9a are disposed individually on the left-hand side in FIG. 1 of the inlet piping unit 2A and on the right-hand side in FIG. 1 of the outlet piping unit 2B. The communicating holes 905 of the central plates 9a disposed on the respective sides of the inlet and outlet piping units 2A and 2B are made larger than that of the central plate 9a shown in FIG. 7.

The first space 40 of the inlet piping unit 2A is communicated via the communicating hole 100 and the communicating hole 905 of the central plate 9a with the tank portions of the tube units 7 positioned on the left-hand side of FIG. 1. Accordingly, the refrigerant invited through the inlet piping unit 2A forming an inlet port flows through the first space into the tank portions of the tube units 7. In the above, the tank portions of the tube units 7 permitting air inflow through the first space 40 of the inlet piping unit 2A form an inlet tank portion 200 as a first tank portion of the present invention.

A plurality of tubes 41 through 47 communicating with the inlet tank portion 200 constitute a first tube group 401. This first tube group 401 has other tank portions provided at the other end which constitute an intermediate tank portion 201.

The intermediate tank portion 201 is formed over the whole width of the refrigerant evaporator 1, this intermediate tank portion 201 being communicated with a second tube group 402 similarly U-shaped.

The intermediate tank portion 201 forms a second tank portion 201a of one refrigerant evaporator which is connected with the other refrigerant evaporator in series and a first tank portion 201b of the other refrigerant evaporator.

A portion of the intermediate tank portion 201 to which the first tube group 401 is connected forms the second tank portion 201a, and a portion of the intermediate tank portion 201 to which the second tube group 402 is connected forms the first tank portion 201b. The communicating hole 904 of the central tube unit 9 confronting the second tank portion 201a forms an outlet port of one refrigerant evaporator and another communicating hole 904 of the central tube unit 9 confronting the first tank portion 201b forms an inlet port of another refrigerant evaporator. This second tube group 402 has an outlet tank portion 202 as a second tank portion of another refrigerant evaporator provided at the other end.

The inlet piping unit 2A forming the inlet port is connected with a clad pipe 12, while the outlet piping unit 2B forming an outlet port is similarly connected with another clad pipe 12. The other ends of these clad pipes 12 are connected with an expansion valve housing 4. This expansion valve housing 4 is connected with an outlet piping unit 2B and inlet piping unit 2A. The outlet piping is connected with the outlet piping unit 2B, while the inlet piping unit 2A is connected via a publicly-known expansion valve with the inlet piping unit 2A. Evaporator 1 has side plates 11 disposed on either side thereof for the purpose of its reinforcement.

Although in the embodiment the inlet piping unit 2A and the outlet piping unit 2B are connected via the clad pipes 12 with the expansion valve housing 4, inlet piping unit 2A and outlet piping unit 2B may be directly connected with the expansion valve housing 4 without using the clad pipes 12.

The operation of this embodiment will now be described. Refrigerant from a condenser of an automotive air conditioner flows through the expansion valve disposed inside the expansion valve housing 4 and the inlet piping unit 2A into the first space 40. Then, the refrigerant flows from space 40 into the inlet tank portion 200. The refrigerant flows from inlet tank portion 200 through the U-shaped flow paths of the first tube group 401 and into the intermediate tank portion 201.

The refrigerant flows from intermediate tank portion 201*a* positioned in the left-hand half of FIG. 1 through the second spaces 50 and 71 of the inlet piping unit 2A and the outlet piping unit 2B and into the intermediate tank portion 201*b* positioned on the right-hand side in FIG. 1. The refrigerant flowing into the right hand intermediate tank portion 201*b* flows through the U-shaped paths of the second tube group 402 and into the outlet tank portion 202. The refrigerant flowing into the outlet tank portion 202 flows in the leftward direction in FIG. 1 and through the outlet piping unit 2B and the outlet piping connected in the vicinity of the center of the evaporator 1, and flows out toward the side of a compressor of the air conditioner. The foregoing flow of the refrigerant is indicated by the arrows F in FIG. 1.

The sum of the length of the flow path of a stream along the end wall 16 of the inlet tank portion 200 and the length of the flow path of a stream along an end wall 15 of the intermediate tank portion 201 and reaching the outlet piping unit 2B is the longest among the lengths of the flow paths of other streams passing the respective tubes and reaching the outlet piping unit 2B. Thus, the flow resistance increases by a difference between them.

Figure 13:
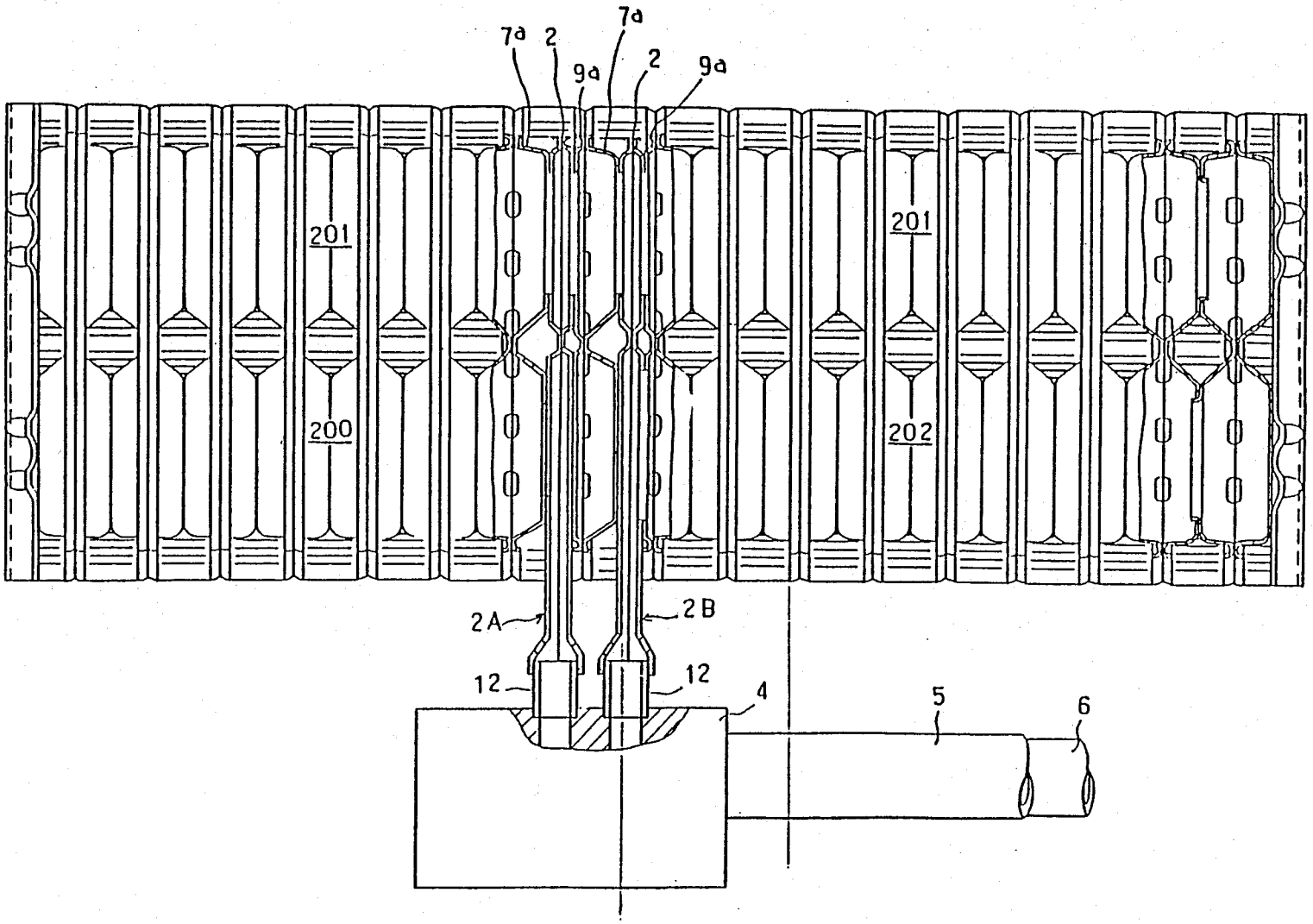
FIG. 13 is a top view of an evaporator according to a second embodiment of the invention.

Though the liquid phase refrigerant introduced into the inlet tank portion 200 and the intermediate tank portion 201 has a tendency to flow in a large amount toward an end wall 16 and an end wall 15 respectively, and the gas phase refrigerant introduced into the inlet tank portion 200 and the intermediate tank portion 201 has a tendency to remain at points which are close to the communicating hole 905 and the other end wall 151 of the intermediate tank portion respectively. The actual amount of the liquid phase refrigerant flowing into each tube is the same. Since the flow resistance of the flowing path from the inlet port to the outlet port of each tank via each tube increases in accordance with the distance between the tube and end wall 15 or the end wall 16; such flow resistance cancel the tendency described above. Therefore the variation in the temperature distribution of the air passing through the evaporator is made uniform. FIG. 13 shows another embodiment of the present invention, which corresponds to FIG. 1 described above. In the embodiment of FIG. 1, the central plates 9*a* are disposed on the respective sides of the inlet piping unit 2A and the outlet piping unit 2B, and the spacing between the inlet piping unit 2A and the outlet piping unit 2B is set narrower than the width of the tube unit 7. However, in the embodiment shown in FIG. 13, the central plate 9*a* is disposed on the right-hand side 7*a* the drawing of the piping unit 2A, and the tube main plate 7*a* is disposed on the left side. Further, the main plate 7*a* is disposed on the left-hand side in the drawing of the outlet piping unit 2B, and the central plate 9*a* is disposed on the right side. Accordingly, the spacing between the inlet piping unit 2A and the outlet piping unit 2B of the embodiment shown in FIG. 13 is wider than that of the embodiment shown in FIG. 1 by the difference in thickness between the main plate 7*a* and the central plate 9*a*. The other structures and the operation are identical with those of the first embodiment described above, hence, no description is given.

Figure 14:
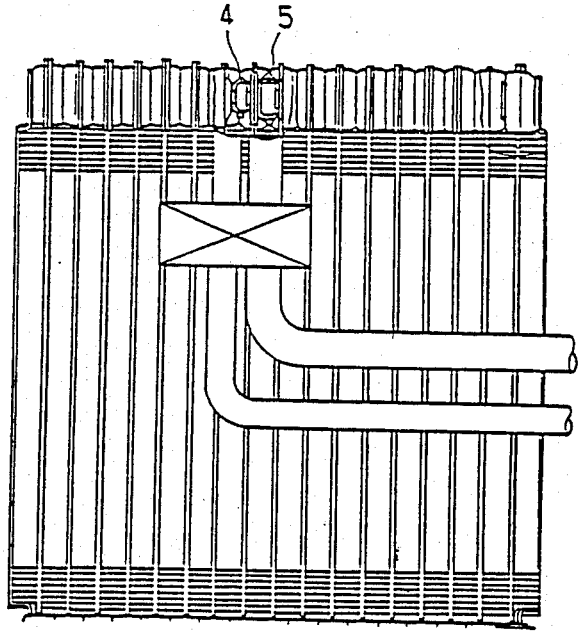
FIG. 14 is a front view of the second embodiment of the invention.
Figure 15:
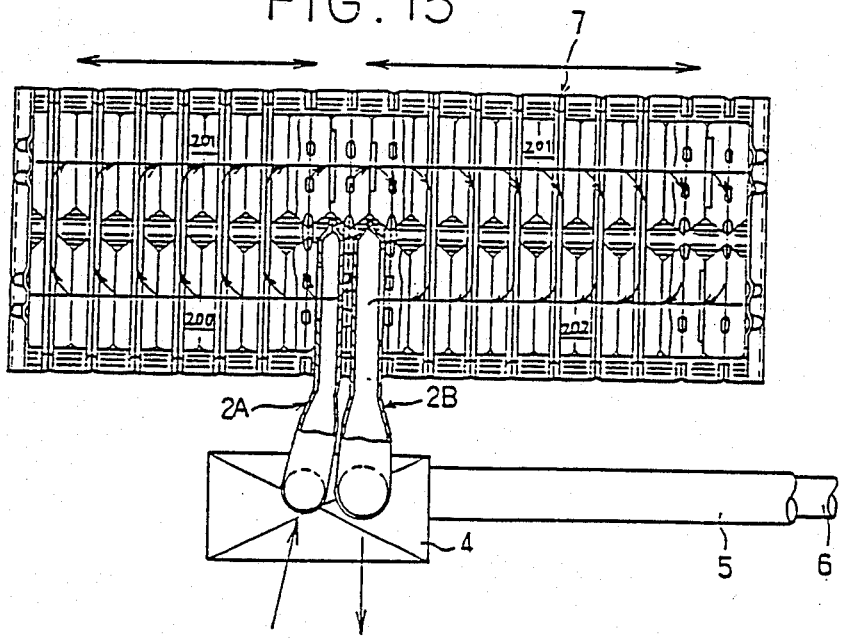
FIG. 15 is a top view of an evaporator representative of a third embodiment of the invention.
Figure 16:
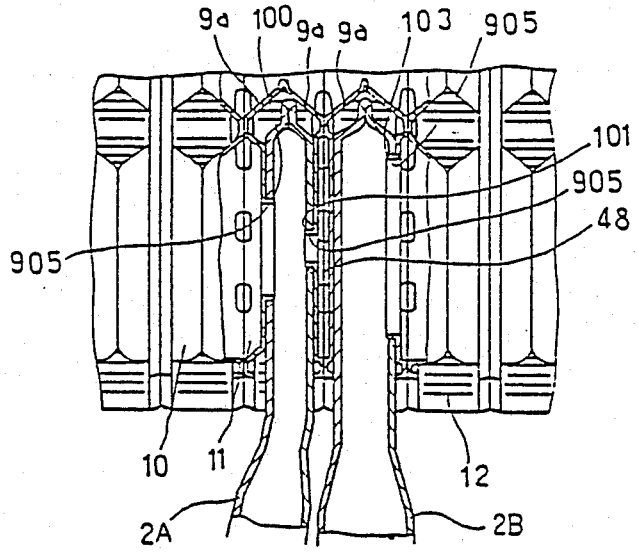
FIG. 16 is an enlarged view of an important portion of FIG. 15.

FIG. 14 is a front view of an evaporator representative of a third embodiment of the present invention, wherein portions of the pipes are illustrated in cross section. FIG. 15 is a top view of the evaporator shown in FIG. 14, and FIG. 16 is an enlarged fragmentary sectional view of connection portions of the inlet piping 2A and the outlet piping 2B shown in FIG. 15.

In the embodiments shown in FIGS. 1 and 13, the inlet piping unit 2A and the outlet piping unit 2B constitute a part of the intermediate tank 201 also. However, in the embodiment shown in FIGS. 14 through 16, the inlet piping unit 2A is joined with the inlet tank section 200 only, and the outlet piping unit 2B with the outlet tank 202 only. Accordingly, the intermediate tank section 201 is formed by successively laminating the tube units 7.

Figure 17:
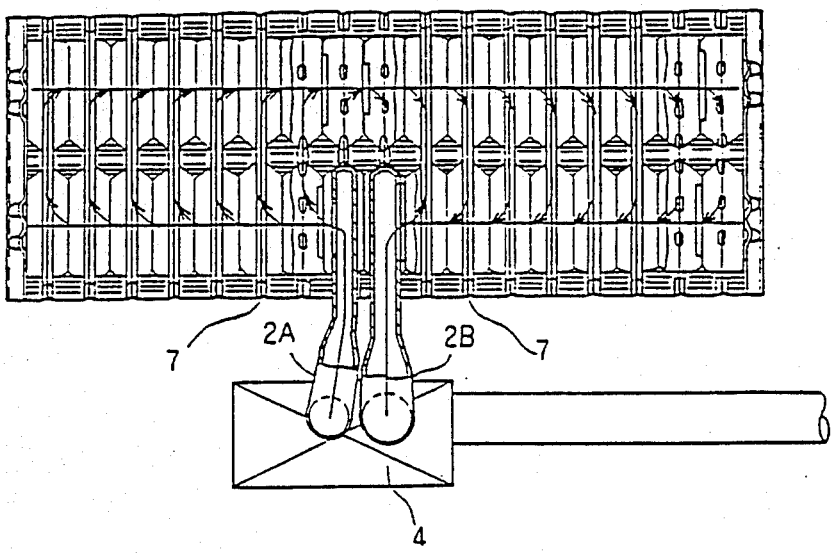
FIG. 17 is a top view of an evaporator representative of a fourth embodiment of the invention.
Figure 18:
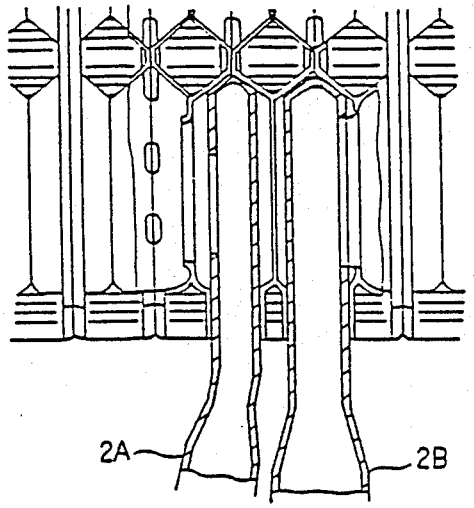
FIG. 18 is an enlarged view of an important portion of FIG. 17.
Figure 19:
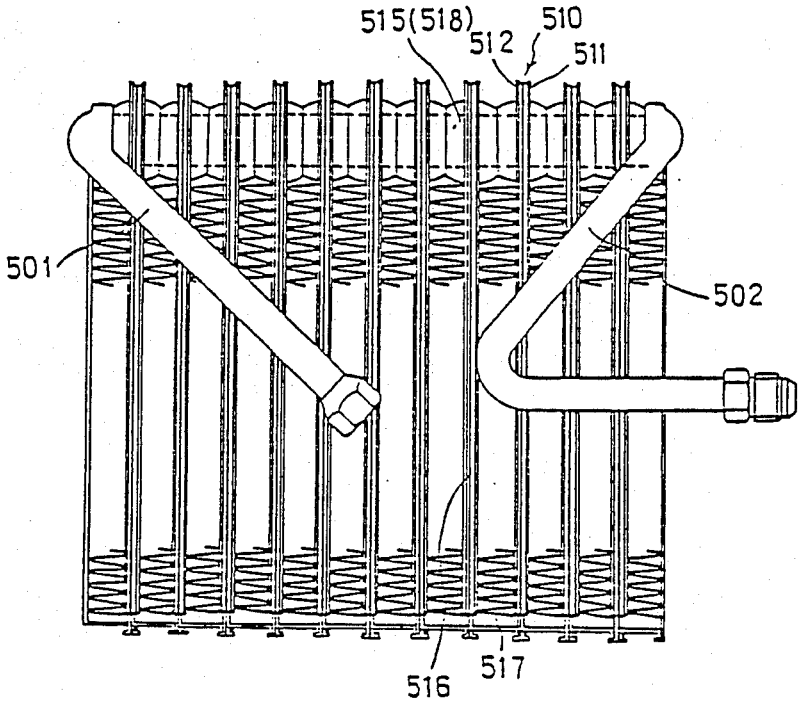
FIG. 19 is a front view showing a conventional evaporator.
Figure 20A:
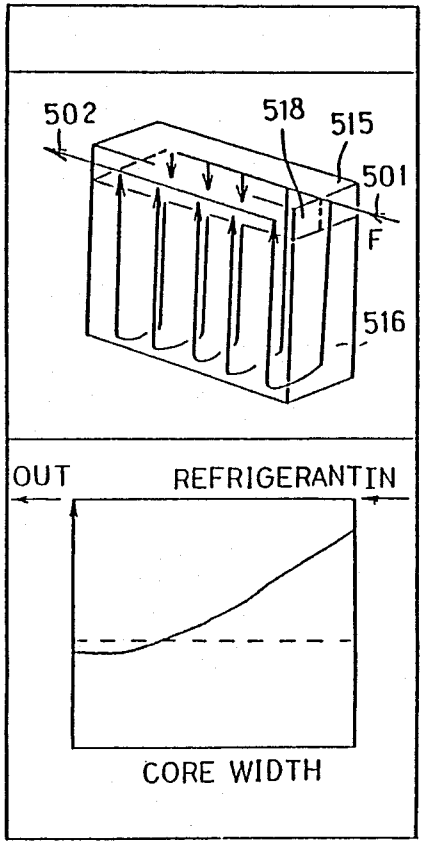
FIGS. 20*a–c* are diagrams showing the manner of flowing in the conventional evaporator.
Figure 20B:
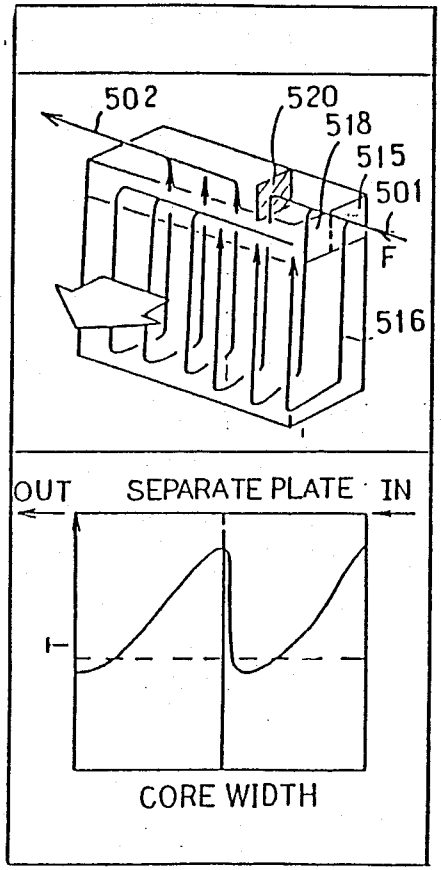
Figure 20C:
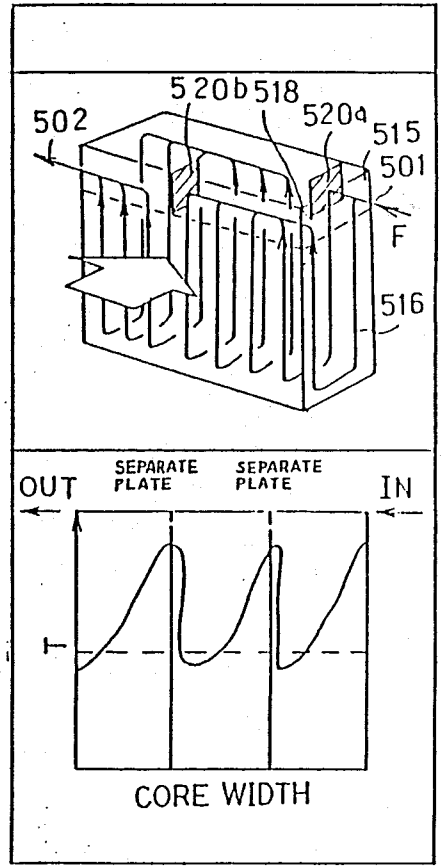
Figure 21:
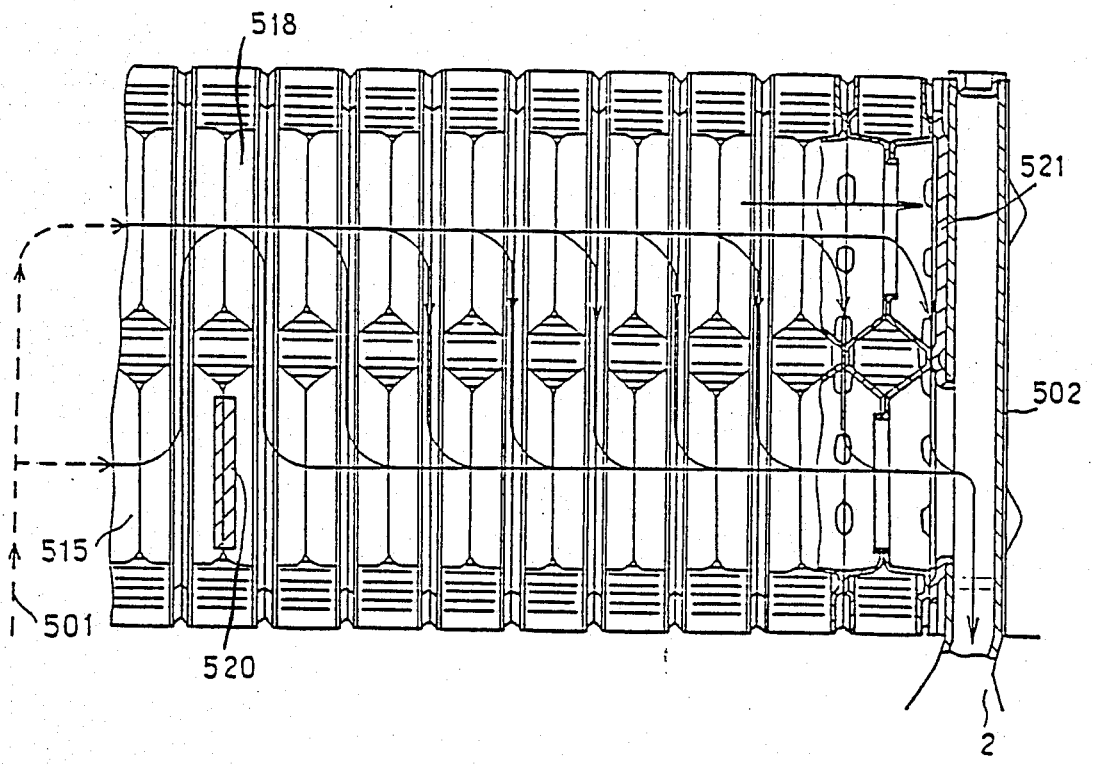
FIG. 21 is a diagram showing in greater detail the stream of a refrigerant in the conventional evaporator.

FIG. 17 is a top view of an evaporator representative of a fourth embodiment of the present invention, and FIG. 18 is an enlarged fragmentary sectional view showing in detail connection portions of an inlet piping unit 2A and an outlet piping unit 2B shown in FIG. 17.

In the embodiment shown in FIGS. 17 and 18, the inlet piping and outlet piping are inserted in the tube units 7 formed by joining the ordinary main plates 7*a* together. This embodiment also has the structure wherein the inlet piping unit and the outlet piping are connected independently with the inlet tank section 200 and the outlet tank 202, respectively. By adopting such a structure as shown in FIGS. 17 and 18, there is no need to use specially formed plates such as the central plates used in the other embodiments described above. The tube units of this embodiment should be formed with insertion holes to insert and connect the inlet piping unit 2A and the outlet piping unit 2B. The other structures and the operation of each of the third embodiment and the fourth embodiment are identical with those of the first embodiment described above, hence, no description is given.

In each of the first through fourth embodiments described above, the inlet piping unit 2A and the outlet piping unit 2B are provided in adjacent positional relation, hence, the efficiency of working in connecting the expansion valve housing 4 is better.

Figure 22:
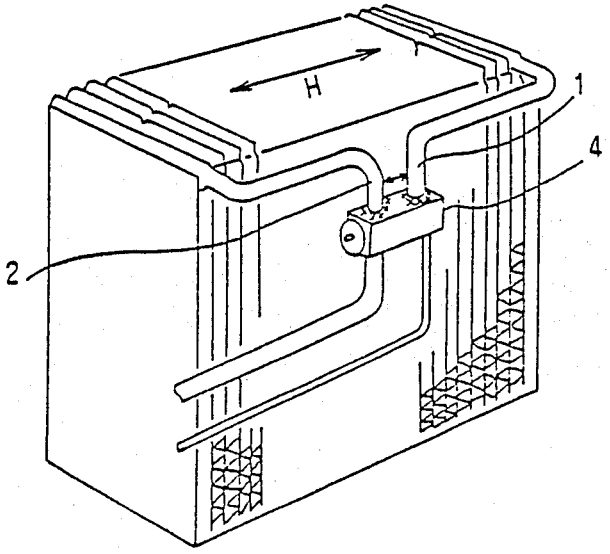
FIG. 22 is a perspective view showing the conventional evaporator.

In the case as shown in FIG. 22 where an inlet piping 1 and an outlet piping 2 are provided in spaced positional relation, if the evaporator 1 is contracted in the widthwise direction H due to some load, the spacing between the distal ends of the inlet piping 1 and the outlet piping 2 also decreases, after all, the efficiency of working in connecting the expansion valve housing 4 is remarkably lowered. However, since the inlet piping unit 2A and the outlet piping unit 2B of the embodiments described above are disposed in adjacent positional relation, even if the evaporator 1 is contracted in the widthwise direction H, the amount of contraction of the spacing between the two piping units 2A and 2B is very small, hence, the process of connecting the expansion valve housing 4 can be accomplished easily.

Figure 23:
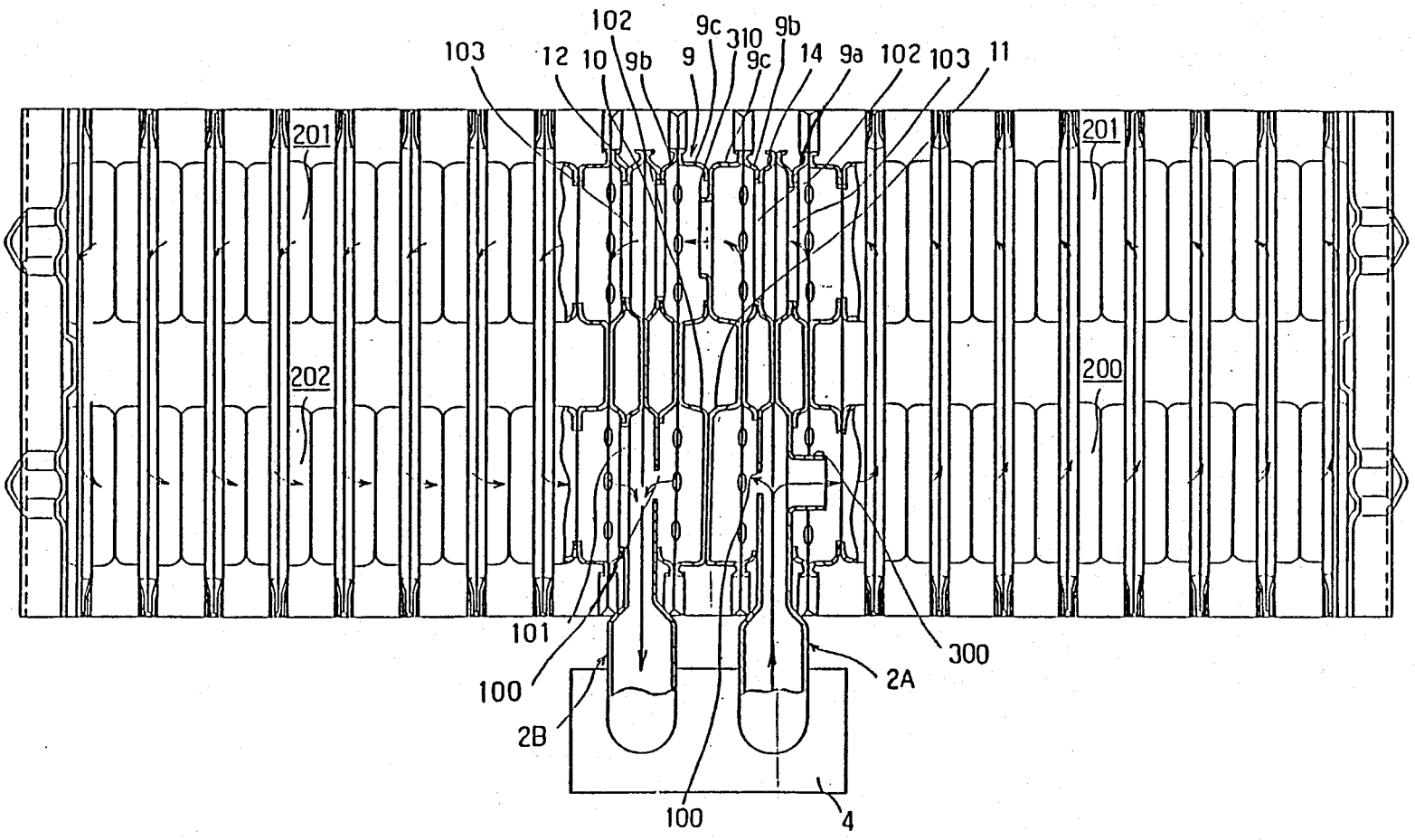
FIG. 23 is a top view of an evaporator representative of a fifth embodiment of the invention.

FIG. 23 is a top view of a fifth embodiment of the invention wherein a central portion is illustrated in cross section. The inlet piping unit 2A and the outlet piping unit 2B are connected with the expansion valve housing 4 at the right-hand position and the left-hand position in FIG. 23 respectively.

The inlet piping unit 2A is formed by pair of piping unit forming plates 2*a* and 2*b* in confronting relation. By joining two inlet piping unit forming plates 2*a* and 2*b* together in confronting relation. There are formed the first space 40 and the second space 50 in the inside. In the inlet piping unit 2A, the piping unit forming plate 2*a* has a communicating hole 100 being opposed to the first space 40, and the piping unit forming plate 2*b* has a communicating hole 101 confronting the communicating hole 100. The communicating hole 101 has a cylindrical nozzle 300 in its periphery. An opening area of the communicating hole 101 is larger than that of the communicating hole 100, and almost all of the refrigerant entering first space 40 flows into the inlet tank portion 200 through the communicating hole 101. The outlet piping unit 2B is formed by a pair of piping unit forming plates in confronting relation and has a substantially identical configuration. Though, the outlet piping unit 2B has no nozzle in the periphery of the communicating hole 101.

Two of the central tube units 9 are disposed at the position between the inlet piping unit 2A and the outlet piping unit 2B. The central tube unit is formed by the central tube forming plate shown in FIGS. 24 and 25 and the central tube forming plate 9C having a same recession depth as the main plate shown in FIGS. 3 through 5 in confronting relation.

As shown in FIGS. 24 and 25, the central tube forming plate 9*b* has refrigerant passing holes 904*b* and 905*b* which have same area. The other central tube forming plate 9C has two tank recesses. One of the two tank recesses has a hole and the other has no hole. The inlet piping unit 2A and the outlet piping unit 2B are formed by joining the central tube forming plate 9*b* to a central tube forming plate 9C in such a manner that the tank recesses do not communicate and the tank recesses having holes form a part of the intermediate tank portion 201. The central tube forming plate 9C of the central tube unit 9 joined to the inlet piping unit 2A has a cylindrical nozzle 310 in a periphery of a hole formed in its tank recess. The nozzle 310 is opened in the direction of the refrigerant flowing in the intermediate tank portion 201.

The tube units formed by the central tube forming plates 9*b* and the main plate 7 are joined to the inlet piping unit 2A and the outlet piping unit 2B at the opposite side of the central tube unit 9.

Nozzles 300 and 310 formed in the inlet piping unit and the outlet piping unit, respectively tend to propel refrigerant at the inlet tank portion 200 and the intermediate tank portion 201 to increase the amount of the liquid phase refrigerant which flows into the front portion of both tanks 200, 201 in the direction of the axis thereof so that the flow will not become insufficient. The amount of the liquid phase refrigerant is made sufficient by modulating the diameter and the length of the nozzle 300, 310.

Figure 29:
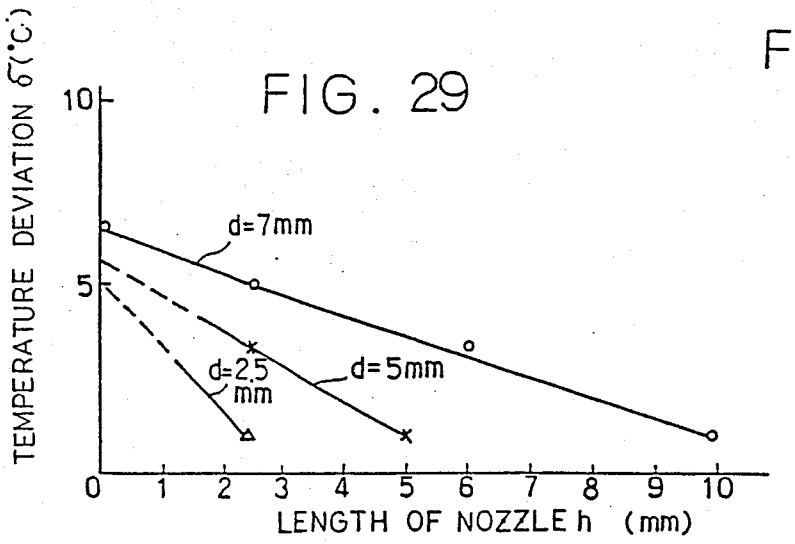
FIG. 29 is diagram showing a relation of a length of nozzle and a temperature deviation of air.

FIG. 29 shows the relation between the temperature deviation of air passed through the evaporator and the length h and the diameter d of nozzle 300 which is formed in only the inlet piping unit 2A.

The temperature deviation δ is defined by the following formula.

$$\delta = \sqrt{\frac{\sum_{n=1}^{n} (\mathrm{Tan} - \overline{Ta})^2}{n}}$$

In the above formula, Tan represents a temperature of air passed through the evaporator at n different points along the width of the evaporator. Ta represents an average of the temperatures of Tan.

Figure 30:
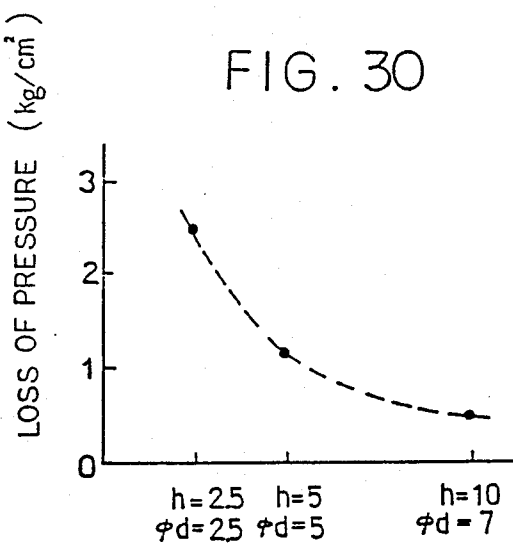
FIG. 30 is a diagram showing a relation between a shape of nozzle and flowing loss.

FIG. 30 shows the relation between the length h and the diameter d of nozzle 300 and the flowing loss of the refrigerant. As clearly indicated in FIGS. 29 and 30, when the length h of the nozzle is 10 mm and the diameter d of the nozzle is 7 mm, the temperature deviation of air and the flowing loss of the refrigerant is smallest. In this embodiment, the length h is 10 mm and the diameter d is 7 mm.

The nozzle 310 formed in the central tube unit 9 is not absolutely necessary and the position of the nozzle 310 can be changed from that shown in the drawings. The shape of nozzles 300 and 310 may be tapered.

FIG. 35 plots the temperature of air passed through the evaporator shown in FIG. 23. As shown in FIG. 35, the temperature is almost uniform across the entire width of the evaporator. FIG. 35 is derived from a test wherein the temperature of air coming through the evaporator was about 30° C., the humidity was about 60% and air flowed at a rate of 300 $m^3$/hour. Evaporation pressure of the refrigerant was 2.5 kg/$cm^2$, the degree of super heat of the refrigerant was 10° C. and amount of refrigerant flow was 100 l/hour.

Figure 31:
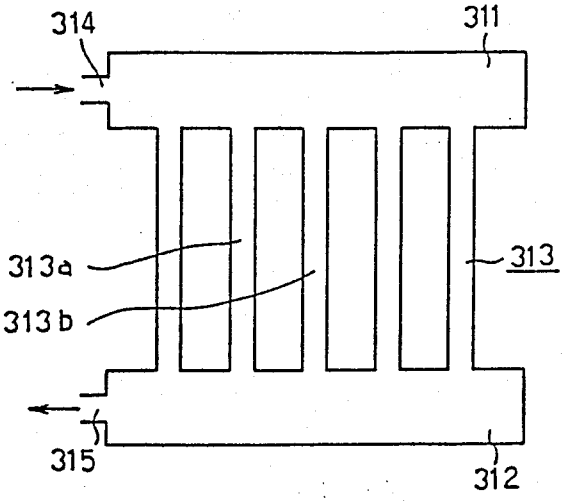
FIG. 31 and FIG. 32 are schematic views showing of the present invention.

FIG. 33 is a schematic view of all of the embodiments described above. Two of the evaporators shown in FIG. 31 are connected to each other in series. The outlet port 315*a* of one of the evaporators is connected to the inlet port 314*b* of the other evaporator. The inlet port 314*a* of one of the evaporators and the outlet port 315*b* of the other evaporator abut each other.

Figure 32:
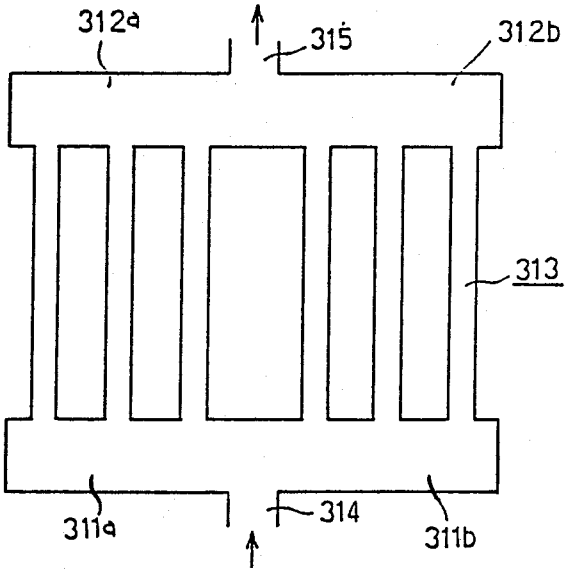

In all of the embodiments described above, two of the evaporators shown schematically in FIG. 31 are connected to each other in series but two of them can be connected in parallel as shown schematically in FIG. 32 and only one evaporator as shown in FIG. 31 can be used.

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed:

1. An evaporator comprising:

a first portion having an inlet port adapted to receive a gas-liquid phase refrigerant;

a plurality of tubes each having first and second ends, said first end being connected to said first tank portion so that the refrigerant is distributed thereinto and the refrigerant is evaporated therein while the refrigerant passes therethrough, said plurality of tubes being arranged in such a manner that said first ends form a line along a direction of refrigerant flow within said first tank portion; and a second tank portion having an outlet port through which refrigerant exits said evaporator said second end of said tube being connected to said second tank portion so that refrigerant passed through said tubes flows into said second tank portion, wherein for each tube, a flow passage is defined by that tube, at least a portion of said first tank, at least a portion of said second tank, said inlet port and said outlet port, the length of each such flow passage having greater far successive tubes along said line.

2. An evaporator for evaporating refrigerant claimed in claim 1, wherein:

said inlet port has a nozzle shape for spouting the refrigerant into said first tank portion.

3. An evaporator for evaporating refrigerant claimed in claim 1, wherein said first tank portion, said second tank portion and said tubes are formed by a plurality of tube-units each of which comprises a pair of plates having first tank depression for said first tank portion, said second tank portion and said tube.

4. An evaporator for evaporating refrigerant claimed in claim 1 wherein each of said tubes is an U-shape and said first tank portion and said second tank portion are disposed at each end of said U-shaped tubes.

5. An evaporator for evaporating refrigerant comprising:

a first tank portion having an inlet port for receiving a gas-liquid phase refrigerant to be evaporated;

a plurality of tubes one end of which is connected to said first tank portion so that the refrigerant is distributed thereinto and the refrigerant is evaporated therein while the refrigerant passes therethrough, a plurality of tubes being arranged in such a manner that said tubes line along with a direction of the refrigerant flow within said first tank portion; and a second tank portion having an outlet port for deriving the refrigerant therefrom, the other end of said tube is connected to said second tanks portion so that the refrigerant passed through said tubes is gathered within said second tank portion, said inlet port and said outlet port being disposed at said first tank portion and said second tank portion respectively in such a manner that a direction of refrigerant flow within said first tank portion is opposite from a direction of refrigerant flow in said second tank portion.

6. An evaporator for evaporating refrigerant claimed in claim 5, wherein:

said inlet port has a nozzle shape for spouting the refrigerant into said first tan portion.

7. An evaporator for evaporating refrigerant claimed in claim 5, wherein said first tank portion, said second tank portion and said tubes are formed by a plurality of tube-units each of which comprises a pair of plates having first tank depression for said first tank portion, said second tank portion and said tube.

8. An evaporator for evaporating refrigerant claimed in claim 5 wherein each of said tubes is an U-shape and said first tank portion and said second tank portion are disposed at each end of said U-shaped tubes.

9. An evaporator for evaporating refrigerant comprising:

a first tank portion having an inlet port close to a first end thereof for receiving a gas-liquid phase refrigerant and a second end;

a plurality of tubes one end of each of which is connected to said first tank portion so that the refrigerant is distributed thereinto and the refrigerant is evaporated therein while the refrigerant passes therethrough, a plurality of tubes being arranged along the length of said first tank portion from its first end to its second end; and a second tank portion having an outlet port close to a first end thereof and a second end, the other end of each of said tubes being connected to said second tank portion at the position corresponding to the point of said tube to said first tank portion, a first end of a first tube of said plurality of tubes being connected to said first tank portion at a position closer to said first end of said first tank portion than a portion at which a first end of a second tube of said plurality of tubes is connected, a second end of said first tube being connected to said second tank portion closer to said first end of said second tank portion than the second end of said second tube.

10. An evaporator for evaporating refrigerant claimed in claim 9, wherein:

said inlet port has a nozzle shape for spouting the refrigerant into said first tank portion.

11. An evaporator for evaporating refrigerant claimed in claim 9, wherein said first tank portion, said second tank portion and said tubes are formed by a plurality of tube-units each of which comprises a pair of plates having first tank depression for said first tank portion, said second tank portion and said tube.

12. An evaporator for evaporating refrigerant claimed in claim 9 wherein each of said tubes is an U-shape and said first tank portion and said second tank portion are disposed at each end of said U-shaped tubes.

13. An evaporator comprising:

an inlet tank portion;

an outlet tank portion;

an intermediate tank portion, said intermediate tank portion having an axis substantially parallel with those of said inlet and outlet tank portions;

a first plurality of tubes connecting said inlet tank portion with said intermediate tank portion and a second plurality of tubes connecting said outlet tank portion with said intermediate tank portion, wherein:

an inlet port for receiving refrigerant disposed at an end portion of said inlet tank portion adjacent to said outlet tank portion; and an outlet port from which refrigerant flows from said evaporator disposed at an end portion of said outlet tank portion adjacent to said inlet tank portion.

14. An evaporator claimed in claim 13 wherein:

said inlet tank portion, outlet tank portion, intermediate tank portion and said first and second pluralities of tubes comprise a plurality of units, each unit including two plates each plate having a depression.

15. An evaporator as claimed in claim 14 wherein:

said inlet tank portion and said outlet tank portion and intermediate tank portion are cylindrical in shape;

said tubes are U-shaped and wherein one end of each tube of said first and second pluralities of tubes is connected to said intermediate tank portion and the other end of each tube of said first plurality of tubes is connected to said inlet tank portion and the other end of each tube of said second plurality of tubes is connected to said outlet tank portion.

16. An evaporator claimed in claim 13 wherein:
said inlet port has a nozzle shape for spouting the refrigerant into said inlet tank portion.

17. An evaporator as claimed in claim 13 wherein
said inlet port has a nozzle shape for spouting the refrigerant into said inlet tank portion, and
said intermediate tank portion has a nozzle for spouting the refrigerant at a part of said intermediate tank portion between where said first tubes are connected and where said second tubes are connected.

18. An evaporator comprising:
a first tank portion having an inlet port adapted to receive a gas-liquid phase refrigerant
a plurality of tubes each having first and second ends, said first ends being connected to said first tank portion so that the refrigerant is distributed thereinto and the refrigerant is evaporated therein while the refrigerant passes therethrough, said plurality of tubes being arranged in such a manner that said first ends form a line along a direction of refrigerant flow within said first tank portion, and
a second tank portion having an outlet port through which refrigerant exits said evaporator, said second end of said tube being connected to said second tank portion so that refrigerant passed through said tubes flows into said second tank portion, wherein
said inlet port is disposed at a center of said first tank portion so that the refrigerant flows in a direction toward both ends of said first tank portion, and
said outlet port is disposed at a center of said second tank portion so that the refrigerant in said second tank portion flows in an opposite direction to that within said first tank.

19. An evaporator comprising:
an inlet tank portion;
an outlet tank portion;
an intermediate tank portion;
a first plurality of tubes connecting said inlet tank portion with said intermediate tank portion;
a second plurality of tubes connecting said outlet tank portion with said intermediate tank portion;
an inlet piping unit having an inlet port for receiving refrigerant and;
an outlet piping unit having an outlet port through which refrigerant exits said evaporator, wherein
said inlet piping unit is inserted into said inlet tank portion at an end portion adjacent to said outlet tank portion, and
said outlet piping unit is inserted into said outlet tank portion at an end portion adjacent to said inlet tank portion.

20. An evaporator comprising:
an inlet tank portion;
an outlet tank portion;
an intermediate tank portion;
a first plurality of tubes connecting said inlet tank portion;
a second plurality of tubes connecting said outlet tank portion with said intermediate tank portion;
an inlet piping unit having an inlet port for receiving refrigerant and;
an outlet piping unit having an outlet port through which refrigerant exits said evaporator, wherein
said inlet piping unit forms a part of said inlet tank portion, and said outlet piping unit forms a part of said outlet tank portion.

* * * * *